US007912403B2

(12) United States Patent
Kim et al.

(10) Patent No.: US 7,912,403 B2
(45) Date of Patent: Mar. 22, 2011

(54) IMAGE FORMING APPARATUS WITH FRAME AND PRESSING MEMBER

(75) Inventors: Young-min Kim, Suwon-si (KR); Gun-soo Chang, Suwin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 119 days.

(21) Appl. No.: 11/867,813

(22) Filed: Oct. 5, 2007

(65) Prior Publication Data

US 2008/0170875 A1 Jul. 17, 2008

(30) Foreign Application Priority Data

Jan. 15, 2007 (KR) ..... 10-2007-0004353
Apr. 18, 2007 (KR) ..... 10-2007-0038042

(51) Int. Cl.
*G03G 15/00* (2006.01)

(52) U.S. Cl. ..... 399/110; 399/90; 399/111; 399/167

(58) Field of Classification Search ..... 399/90, 399/110, 111, 119, 167, 222, 263, 265; 222/DIG. 1
See application file for complete search history.

(56) References Cited

U.S. PATENT DOCUMENTS 5,943,529 A * 8/1999 Miyabe et al. ..... 399/111
6,006,058 A * 12/1999 Watanabe et al. ..... 399/167
6,163,665 A * 12/2000 Watanabe et al. ..... 399/111
7,079,783 B2 * 7/2006 Yokoi ..... 399/90
7,174,121 B2 * 2/2007 Kuma et al. ..... 399/258
7,466,939 B2 * 12/2008 Nakashima et al. ..... 399/111
2004/0028424 A1 2/2004 Yokoi
2005/0226657 A1 10/2005 Kuma et al.
2007/0154232 A1 * 7/2007 Buchanan et al. ..... 399/90

FOREIGN PATENT DOCUMENTS

| | | |
|---|---|---|
| CN | 1188265 | 7/1998 |
| CN | 1480802 | 3/2004 |
| EP | 0833230 | 4/1998 |
| JP | 2-106383 | 4/1990 |
| JP | 2000-293086 | 10/2000 |
| JP | 2005242203 | 9/2005 |
| KR | 2005-37026 | 4/2005 |
| KR | 10-609907 | 7/2006 |

* cited by examiner

*Primary Examiner* — David M Gray
*Assistant Examiner* — Barnabas T Fekete
(74) *Attorney, Agent, or Firm* — Stanzione & Kim, LLP

(57) ABSTRACT

An image forming apparatus includes a main frame having a first driving force transmitting part, and a first electrode to supply power, a developing cartridge mounted to the main frame, and having a second driving force transmitting part engaged to the first driving force transmitting part to receive a driving force, and a second electrode electrically connected with the first electrode, and a pressing member disposed to the main frame to regulate a widthwise direction movement of the developing cartridge mounted to the main frame to guide an engagement between the first and second driving force transmitting parts, and an electrical connection between the first and second electrodes.

6 Claims, 10 Drawing Sheets

IMAGE FORMING APPARATUS WITH FRAME AND PRESSING MEMBER

CROSS-REFERENCE TO RELATED APPLICATIONS

This application claims priority under 35 U.S.C. §119(a) from Korean Patent Application Nos. 10-2007-0004353 and 10-2007-0038042, respectively filed on Jan. 15, 2007 and Apr. 18, 2007 in the Korean Intellectual Property Office, the disclosures of which are incorporated herein by reference in their entireties.

BACKGROUND OF THE INVENTION

1. Field of the Invention

The present general inventive concept relates to an electrophotographic image forming apparatus to improve an assembly precision of a developing cartridge with respect to a main frame.

2. Description of the Related Art

A conventional electrophotographic image forming apparatus such as a laser printer, a facsimile, a digital copy machine, etc., scans a light to a photosensitive medium charged to a predetermined electric potential to form an electrostatic latent image, develops the latent image with a predetermined colored toner, and transfers and fuses the developed image to a printing medium to print the image.

Referring to FIGS. 1 and 2, a conventional image forming apparatus includes a main frame 1 formed by means of an injection molding for reducing a number of assembling processes and lowering a manufacturing cost, and a developing cartridge 10 slidably coupled to the main frame 1. Here, the developing cartridge 10 includes components such as a developer, a developing roller, a supplying roller, a regulating blade, etc., therein. Here, the main frame 1 is manufactured out of a resin frame by the injection molding for improving productivity and reducing the manufacturing cost, or a metal frame by a press type for reducing a mold manufacturing and improving stability of an electrical connection.

Also, the components of the developing cartridge 10 are supplied with power from a high voltage source (not illustrated) disposed to the main frame 1 for performing a developing process. For this, electrodes 3 and 13 are formed to facing positions of the main frame 1 and the developing cartridge 10, and are electrically connected with each other when the developing cartridge 10 is coupled to the main frame 1.

If the main frame 1 manufactured out of the resin or the metal, and the developing cartridge 10 are manufactured, there exists a design tolerance. That is, if there is a tolerance in a direction of arrow A illustrated in FIG. 2 in the main frame 1 and the developing cartridge 10, the tolerance has an effect on mounting of the developing cartridge 10.

For example, as illustrated by an alternate long and short dash line in FIG. 2, if the developing cartridge 10 is designed to meet a lower limit in design tolerance and the main frame 1 is designed to meet an upper limit in design tolerance, there exists a gap between the main frame 1 and the developing cartridge 10 so that an electrical connection inferiority between the electrodes 3 and 13 can be caused. Accordingly, power is unstably supplied to the developing cartridge 10, thereby causing a print inferiority.

In contrast, if the developing cartridge 10 is designed to meet an upper limit in design tolerance and the main frame 1 is designed to meet a lower limit in design tolerance, the developing cartridge 10 is incapable of being normally mounted to the main frame 1, or being smoothly mounted to the main frame 1.

Also, a gear 15 inside the developing cartridge 10 is incapable of being smoothly engaged with a gear 5 mounted to the main frame 1. Accordingly, the developing cartridge 10 vibrates in an operation of the developing cartridge 10, thereby causing an image inferiority such as a jitter.

SUMMARY OF THE INVENTION

The present general inventive concept provides an image forming apparatus to smoothly mount a developing cartridge to a main frame, and to stably perform an electrical transmission and a gear engagement.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept are achieved by providing an image forming apparatus, comprising a main frame having a first driving force transmitting part and a first electrode to supply power, a developing cartridge mounted to the main frame and having a second driving force transmitting part engaged to the first driving force transmitting part to receive a driving force, and a second electrode electrically connected with the first electrode, and a pressing member disposed to the main frame to regulate a widthwise direction movement of the developing cartridge mounted to the main frame to guide an engagement between the first and second driving force transmitting parts, and an electrical connection between the first and second electrodes.

The pressing member may comprise an elastic plate disposed to the main frame to elastically press the developing cartridge in a direction in which the first and second electrodes are electrically connected with each other.

The elastic plate may comprise an installing part coupled to the main frame, a first contact part and a second contact part to protrude toward the developing cartridge to contact with different positions of the developing cartridge.

The pressing member may comprise a regulating plate rotatably disposed on the main frame, and an elastic member interposed between the regulating plate and the main frame to elastically bias the regulating plate so that the developing cartridge can be positioned in a direction in which the first and second electrodes contact with each other.

The regulating plate may comprise a first regulating part and a second regulating part to contact with different positions of the developing cartridge.

The main frame may comprise resin or metal.

The foregoing and/or other aspects of the present general inventive concept can also be achieved by providing an image forming apparatus, comprising a main frame, a developing cartridge mounted to the main frame, and a pressing member to press the developing cartridge mounted to the main frame in a different direction from a mounting direction of the developing cartridge to regulate a widthwise direction movement of the developing cartridge.

The developing cartridge may comprise a photosensitive medium to sense a scanned light beam to form an image.

The image forming apparatus may further comprise a photosensitive medium cartridge mounted to the main frame in a predetermined direction so that a widthwise direction movement thereof can be regulated by the pressing member and having a photosensitive body to sense a scanned light beam to form an image.

The image forming apparatus may further comprise a waste toner container provided to a side of the developing cartridge and facing the pressing member.

The image forming apparatus may further comprise a first cover provided to be opened and closed to a predetermined position of the main frame which corresponds to a mounting position of the developing cartridge.

The image forming apparatus may further comprise a second cover provided to be opened and closed to a predetermined position of the main frame, wherein the pressing member is formed to the second cover to elastically press the developing cartridge.

The pressing member may comprise an installing part coupled to the second cover, and a first contact part and a second contact part to protrude toward the developing cartridge to contact with different positions of the developing cartridge.

The pressing member may comprise a regulating plate rotatably disposed to the second cover, and an elastic member interposed between the regulating plate and the second cover to elastically bias the regulating plate toward the developing cartridge.

The regulating plate may comprise a first regulating part and a second regulating part to contact with different positions of the developing cartridge.

The foregoing and/or other aspects of the present general inventive concept can also be achieved by providing an image forming apparatus, comprising a main frame, a developing cartridge to be mounted inside the main frame, and a developing cartridge moving device to shift the developing cartridge in a direction to regulate a widthwise direction movement thereof prior to a beginning of a printing process.

The image forming apparatus may further comprise first electrodes mounted inside the main frame to supply power to the developing cartridge, and second electrodes mounted on a side portion of the developing cartridge, such that the developing cartridge is shifted by the moving device to establish a secure electrical connection between the first electrodes and the second electrodes.

The image forming apparatus may further comprise a first driving force transmitting part mounted inside the main frame, a second driving force transmitting part mounted on the developing cartridge to engage with the first driving force transmitting part to receive a driving force to perform a printing operation.

The first driving force transmitting part and the second driving force transmitting part may be gears which each have a thickness corresponding to a potential shifting distance of the developing cartridge.

The main frame may comprise a first cover to open to install the developing cartridge inside the main frame or uninstall the developing cartridge from the main frame.

The main frame may further comprise a second cover to which the developing cartridge moving device is attached.

The second cover may open to install the developing cartridge inside the main frame or uninstall the developing cartridge from the main frame.

The second cover may open to install a waste toner container inside the main frame or uninstall the waste toner container from the main frame.

The image forming apparatus may further comprise a photosensitive medium cartridge comprising a photosensitive medium to form an electrostatic latent image on a printing medium.

The main frame may comprise a first cover to open to install the developing cartridge inside the main frame or uninstall the developing cartridge from the main frame, and a second cover to open to install the photosensitive medium cartridge inside the main frame or uninstall the photosensitive medium cartridge from the main frame.

BRIEF DESCRIPTION OF THE DRAWINGS

These and/or other aspects and utilities of the present general inventive concept will become apparent and more readily appreciated from the following description of the embodiments, taken in conjunction with the accompanying drawings, in which.

DETAILED DESCRIPTION OF THE PREFERRED EMBODIMENTS

Figure 1:
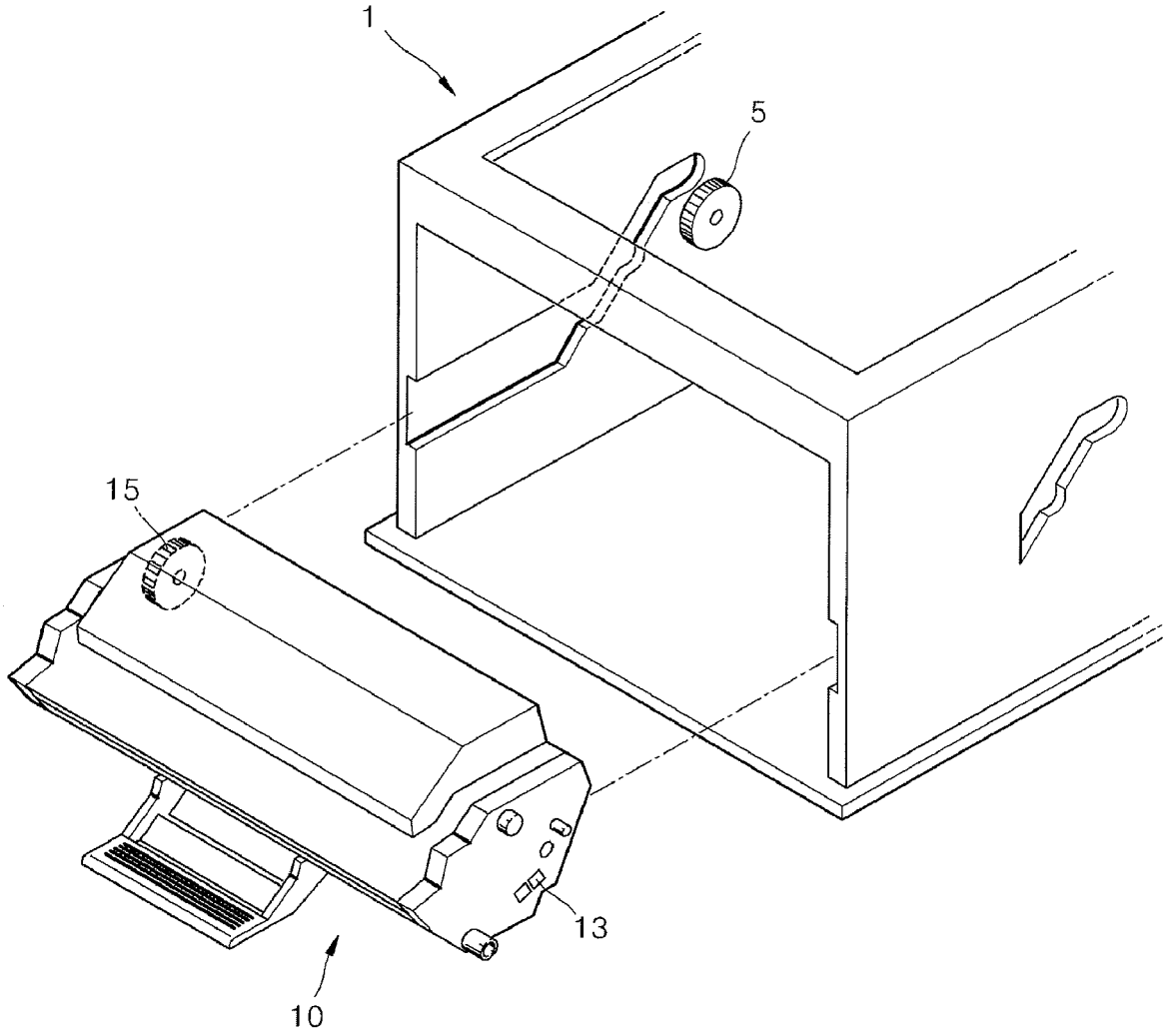
FIG. 1 is an exploded perspective view illustrating a main part of a conventional image forming apparatus.
Figure 2:
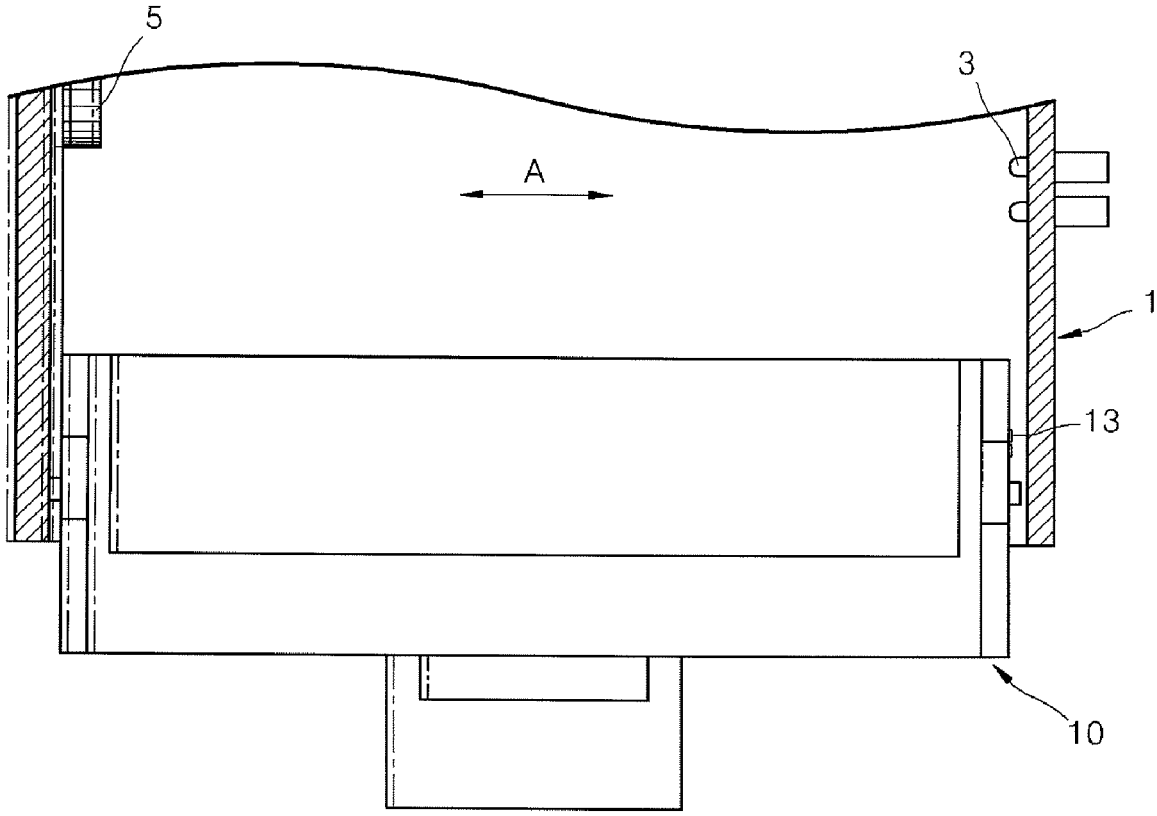
FIG. 2 schematically illustrates a coupling state of a developing cartridge with respect to a main frame of the conventional image forming apparatus.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 3:
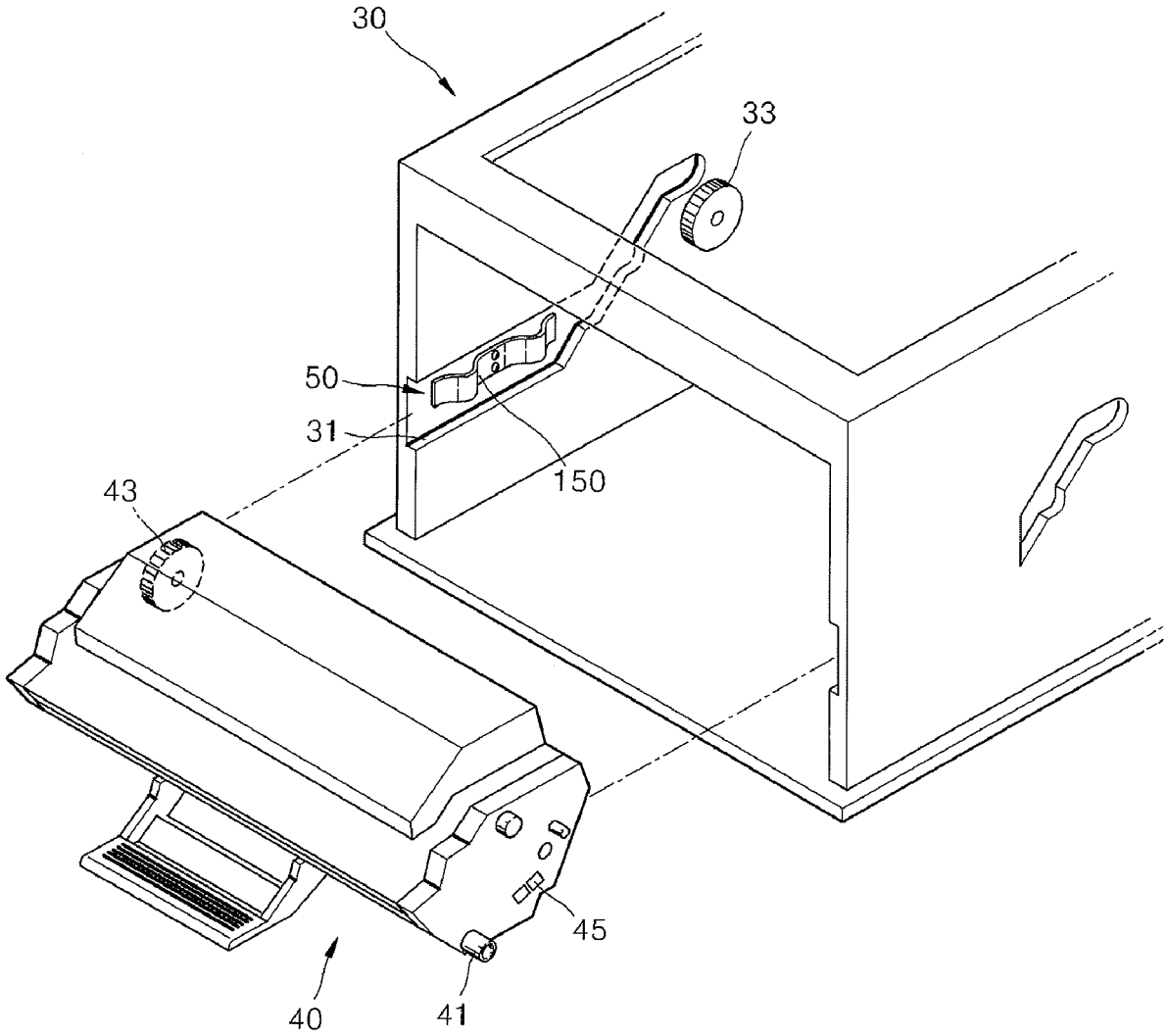
FIG. 3 is an exploded perspective view illustrating a main part of an image forming apparatus according to an exemplary embodiment of the present general inventive concept.
Figure 4A:
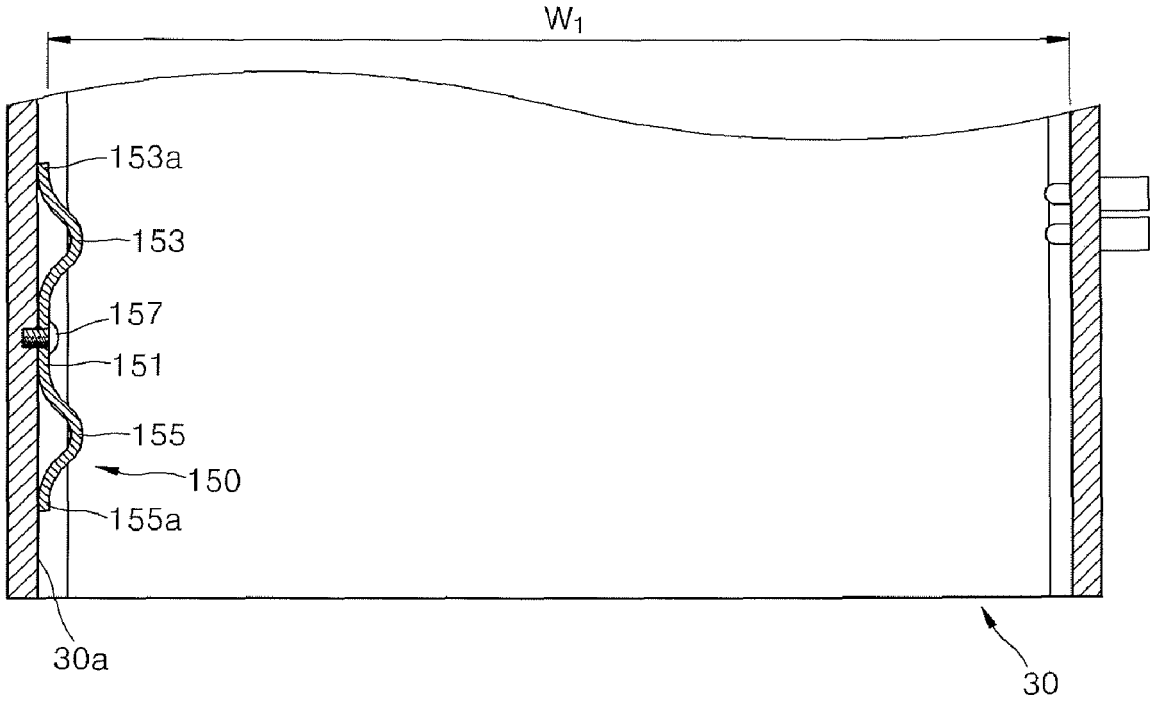
FIG. 4A is a schematic partial sectional view illustrating a main frame of the image forming apparatus according to an exemplary embodiment of the present general inventive concept.
Figure 4B:
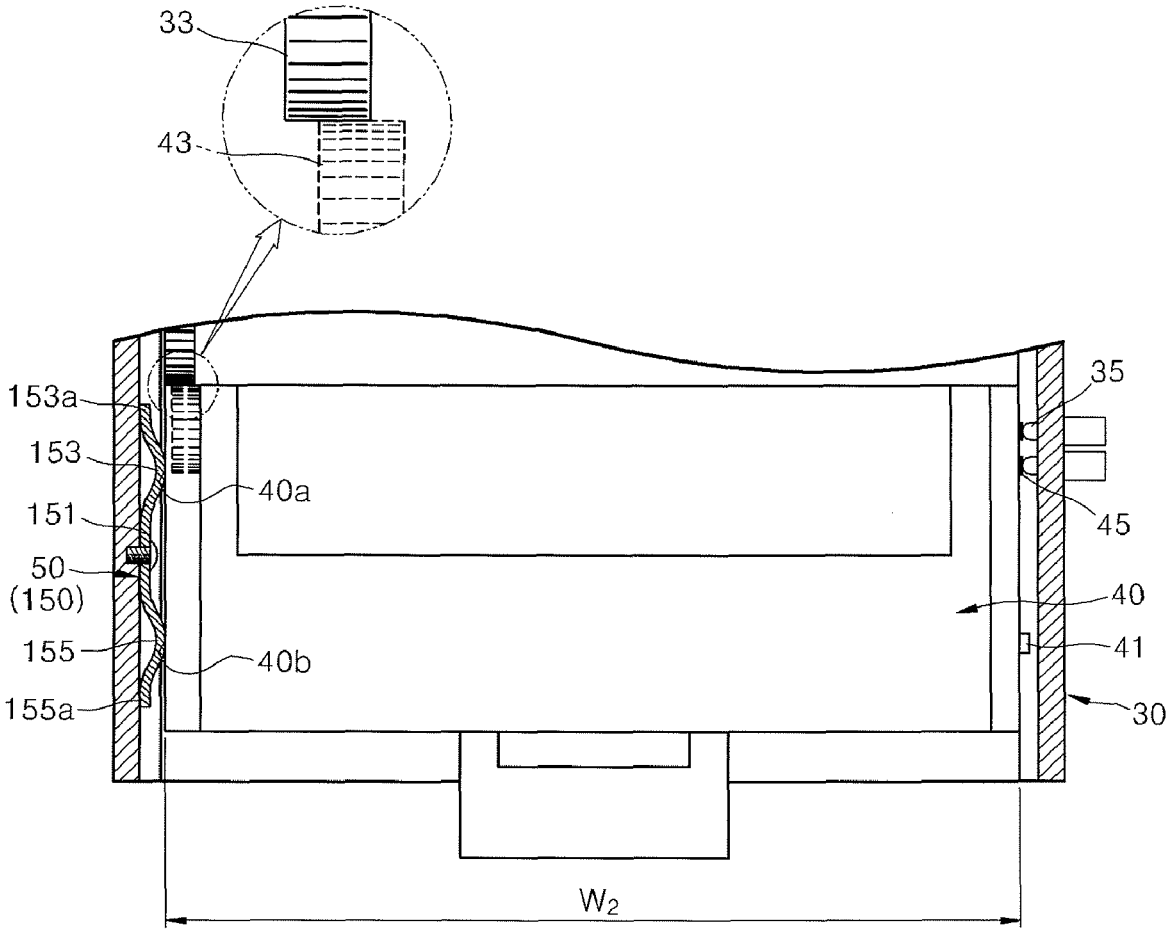
FIG. 4B is a schematic partial sectional view illustrating a coupling state of a developing cartridge with respect to the main frame of the image forming apparatus according to an exemplary embodiment of the present general inventive concept.

As illustrated in FIGS. 3 through 4B, an image forming apparatus according to an exemplary embodiment of the present general inventive concept includes a main frame 30, a developing cartridge 40 mounted in the main frame 30, and a pressing member 50 to regulate a widthwise direction movement of the developing cartridge 40 mounted in the main frame 30. The widthwise direction movement may be performed before a printing operation is begun. The printing operation begins after the image forming apparatus receives information regarding an image to be printed. Therefore, the widthwise direction movement may be performed as compensation regarding slight deviations in a structure of either the developing cartridge 40 or the main frame 30 upon installation of the developing cartridge 40 in the main frame 30.

In the exemplary embodiment of FIGS. 3 through 4B, the main frame 30 and the developing cartridge 40 include a mold object manufactured by an injection molding process to raise productivity, reduce a number of assembling processes, and lower a manufacturing cost.

Elements comprised in the image forming apparatus such as the developing cartridge 40, a photosensitive medium to form an electrostatic latent image on a printing medium, a light scanning unit, a transferring unit, a fusing unit and a feeding and discharging unit, are mounted in the main frame 30. Also, a driving force transmitting part and a power supplying source to supply a driving force and power to the elements are mounted in the main frame 30.

More specifically, a first driving force transmitting part 33 to transmit the driving force to the developing cartridge 40, and a first electrode 35 to supply the power to the developing cartridge 40 are installed in the main frame 30.

The developing cartridge 40 is mounted in the main frame 30 by a sliding coupling. To perform the sliding coupling, a coupling guiding protrusion 41 is formed to the opposite inner surfaces of the developing cartridge 40, and a guiding groove 31 is provided to an inner surface of the main frame 30 to guide the coupling guiding protrusion 41.

Also, the developing cartridge 40 may include elements such as a developer, a developing roller to apply developer corresponding to the electrostatic latent image to the printing medium, a supplying roller, a regulating blade, the photosensitive medium, etc., therein. Also, to drive the inner elements, the developing cartridge 40 includes a second driving force transmitting part 43 to engage with the first driving force transmitting part 33 to receive the driving force, and a second electrode 45 electrically connected with the first electrode 35.

The second electrode 45 faces the first electrode 35 when the developing cartridge 40 is completely mounted in the main frame 30, and is electrically connected with the first electrode 35 during coupling of the developing cartridge 40 with respect to the main frame 30. Accordingly, the pressing member 50 prevents a potential electrical connection inferiority between the first and second electrodes 35 and 45 due to a tolerance designed during a manufacturing process of the main frame 30 and the developing cartridge 40.

The pressing member 50 is disposed inside the main frame 30, and regulates a widthwise direction movement of the developing cartridge 40 mounted in the main frame 30. Accordingly, the pressing member 50 guides both the engagement between the first driving force transmitting part 33 and the second driving force transmitting part 43, as well as the electrical connection between the first electrode 35 and the second electrode 45.

In the exemplary embodiment of FIGS. 3 through 4B, the pressing member 50 can include an elastic plate 150 to elastically press the developing cartridge 40 in an electrical connecting direction between the first and second electrodes 35 and 45. The elastic plate 150 includes an installing part 151, a first contact part 153 and a second contact part 155. The installing part 151 is a part to couple the elastic plate 150 to an inner surface of the main frame 30. Accordingly, the elastic plate 150 is coupled to the inner surface of the main frame 30 by a screw 157 as illustrated in FIG. 4A, or may be coupled thereto by an adhesive, a hook member, an insert molding process, or other known coupling means in the art. The pressing member 50 is not limited to the elastic plate 150, and can include any type of developing cartridge moving device to move the developing cartridge 40 in a manner described herein to perform the intended operations of the present general inventive concept. For example, pins, magnets, pistons, air-pressure devices, and hydraulic devices which can move the developing cartridge 40 in the intended direction can be used alternatively.

The first and second contact parts 153 and 155 protrude toward the developing cartridge 40, and respectively contact different parts of the developing cartridge 40. That is, referring to FIG. 4B, the first contact part 153 contacts a front end part 40*a* side of the developing cartridge 40, and the second contact part 155 contacts a rear end part 40*b* side of the developing cartridge 40. Accordingly, the developing cartridge 40 mounted in the main frame 30 can be prevented from tilting, that is, being inclined inside the main frame 30. Also, first and second end parts 153*a* and 155*a*, respectively, of the first and second contact parts 153 and 155 are free ends, and can slide in a direction away from the installing part 151 by contacting with an inner surface 30*a* of the main frame 30 when the developing cartridge 40 is elastically pressed by the first and second contact parts 153 and 155. Accordingly, the first and second contact parts 153 and 155 elastically press the developing cartridge 40 by an elastic bias force between the free ends 153*a* and 155*a* and the main frame 30, so that the widthwise direction movement of the developing cartridge 40 can be regulated.

As illustrated in FIG. 4A, since the main frame 30 is manufactured by the injection molding, a tolerance of an inner width W1 of the main frame 30 is greater than that of a main frame manufactured by a press process. Similarly, as illustrated in FIG. 4B, a tolerance of a width W2 of the developing cartridge 40 is also greater than that of a main frame manufactured by a press process. In contrast, values of widths W1 and W2 are determined within allowable tolerance ranges so that the developing cartridge 40 can be smoothly mounted in the main frame 30, although the width W1 of the main frame 30 is minimized, and the width W2 of the developing cartridge 40 is maximized. That is, although a forming tolerance is taken into consideration, a design tolerance is determined where W1 is wider than W2.

Also, the elastic plate 150 may be disposed to elastically press in a contacting direction of the first and second electrodes 35 and 45 when the elastic plate 150 is mounted inside the main frame 30. Accordingly, a margin due to tolerance between the main frame 30 and the developing cartridge 40 is formed at the elastic plate 150 side.

The first and second diving force transmitting parts 33 and 43 may include gears engaged with a predetermined gear ratio. Also, although the first and second driving force transmitting parts 33 and 43 deviate from each other as illustrated in FIG. 4B, the driving force can be smoothly transmitted by adjusting a gear width of the first and/or second driving force transmitting parts 33 and 43.

Figure 5:
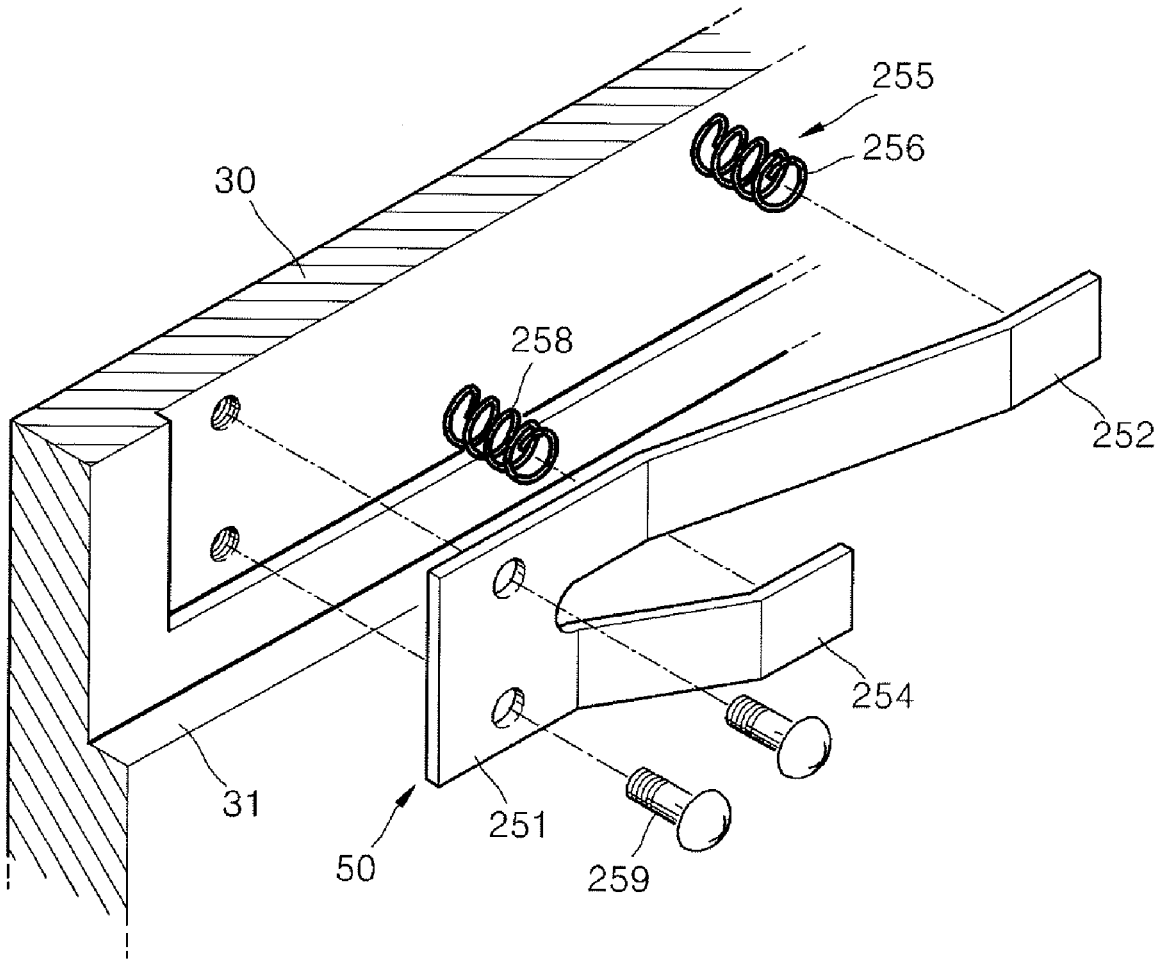
FIG. 5 is an exploded perspective view illustrating a main part of an image forming apparatus according to another exemplary embodiment of the present general inventive concept.
Figure 6A:
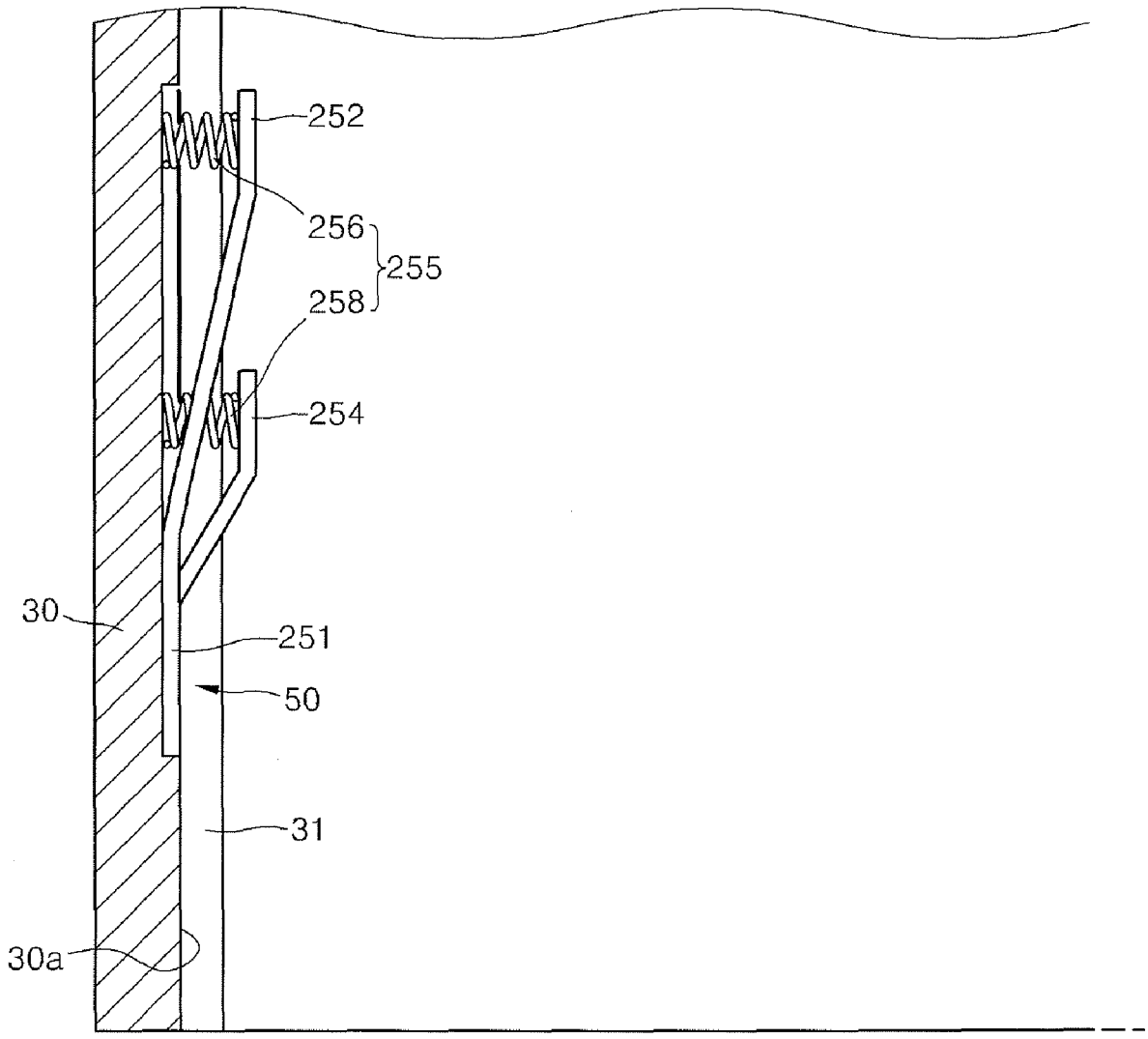
FIG. 6A is a schematic partial sectional view illustrating a main frame of the image forming apparatus according to another exemplary embodiment of the present general inventive concept.
Figure 6B:
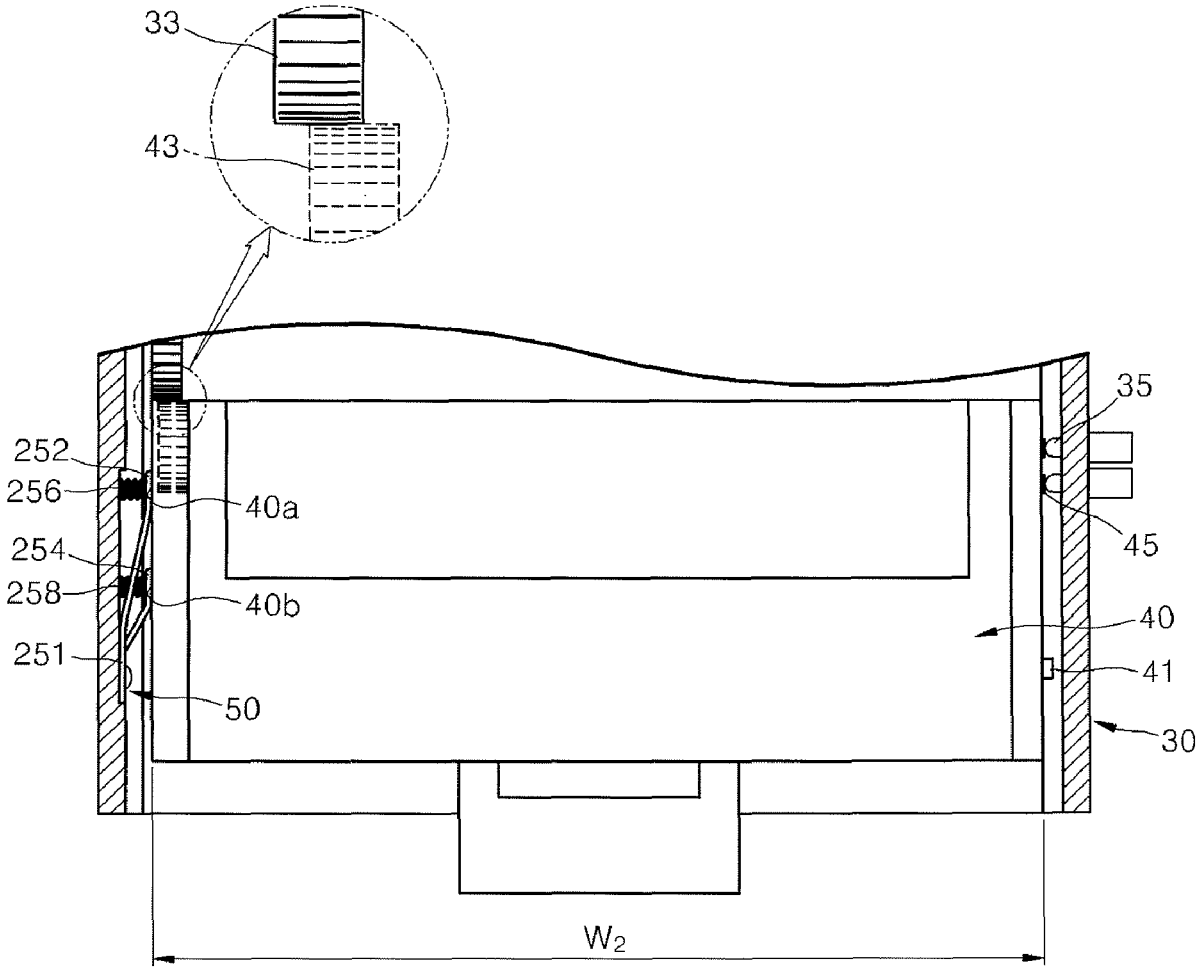
FIG. 6B is a schematic partial sectional view illustrating a coupling state of a developing cartridge with respect to the main frame of the image forming apparatus according to another exemplary embodiment of the present general inventive concept.

Referring to FIGS. 5 through 6B, an image forming apparatus according to another exemplary embodiment of the present general inventive concept includes a main frame 30, a developing cartridge 40 mounted inside the main frame 30, and a pressing member 50 to regulate a widthwise direction movement of the developing cartridge 40 mounted in the main frame 30. Accordingly, the main frame 30, a guiding groove 31, and the developing cartridge 40 may have the same configurations as the image forming apparatus according to the exemplary embodiment of FIGS. 3 through 4B of the present general inventive concept.

In the exemplary embodiment of FIGS. 5 through 6B, the pressing member 50 includes a regulating plate 251 installed to the main frame 30 to change a position of the developing cartridge 40 elastically, and an elastic member 255 to press the regulating plate 251 by elastic bias.

The regulating plate 251 may include a first regulating part 252 and a second regulating part 254 to contact various parts of the developing cartridge 40. That is, the first regulating part 252 contacts a front end side of the developing cartridge 40, and the second regulating part 254 contacts a rear end side of the developing cartridge 40. Accordingly, the developing cartridge 40 mounted in the main frame 30 can be prevented from tilting, that is, being inclined inside the main frame 30. Also, the regulating plate 251 is coupled to an inner surface 30*a* of the main frame 30 by a screw 259 as illustrated in FIG. 5, or may be coupled to the main frame 30 by a hinge (not illustrated).

The elastic member 255 may include a first elastic member 256 and a second elastic member 258 to elastically support the first and second regulating parts 252 and 254, respectively. The elastic member 255 is interposed between the regulating plate 251 and the main frame 30, and elastically biases the regulating plate 251 in a direction in which a first electrode 35 and a second electrode 45 are electrically connected. Accordingly, although there is a forming tolerance when the main frame 30 and the developing cartridge 40 are manufactured by the injection molding process, the first electrode 35 and the second electrode 45 can electrically contact each other when the regulating plate 251 and the elastic member 255 act together to move the developing cartridge 40 in a widthwise direction, thereby preventing an electrical connection inferiority. Also, although first and second driving force transmitting parts 33 and 44 deviate from each other in a widthwise direction due to a forming tolerance in configuring the first and second diving force transmitting parts 33 and 44, the driving force can be smoothly transmitted by adjusting the width of the first and/or second diving force transmitting parts 33 and 44.

In the exemplary embodiment of FIGS. 5 through 6B, the elastic member 255 may include a compression spring interposed between the regulating plate 251 and the main frame 30. Alternatively, the elastic member 255 may include a torsion spring, an extension spring or other known springs in the art. Also, the regulating plate 251 may be provided as an elastic plate without the elastic member 255, as necessary.

Figure 7:
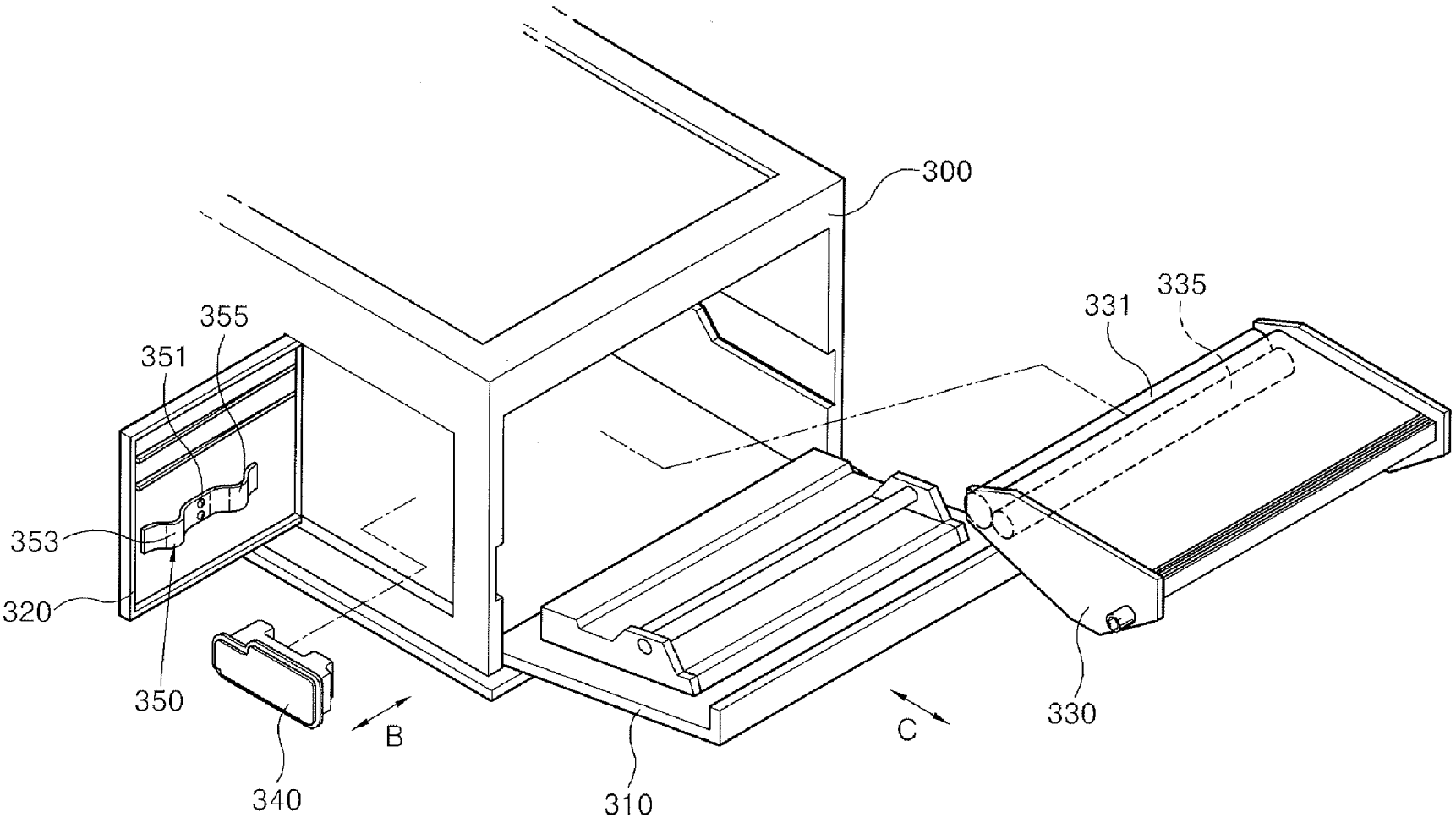
FIG. 7 is an exploded perspective view illustrating a main part of an image forming apparatus according to another exemplary embodiment of the present general inventive concept.

Referring to FIG. 7, an image forming apparatus according to another exemplary embodiment of the present general inventive concept includes a main frame 300, a developing cartridge 330, and a pressing member 350 to press the developing cartridge 330 mounted in the main frame 300 in a lengthwise direction of a developing roller 335 to regulate a widthwise direction movement of the developing cartridge 330. The developing cartridge 330 includes a photosensitive medium 331 to sense a scanned light beam to form an image, and the developing roller 335 and a developer (not illustrated) to develop the image formed by the photosensitive medium 331. The developing cartridge 330 is mounted in the main frame 300 in a perpendicular direction to a lengthwise direction of the developing roller 335. Accordingly, the developing cartridge 330 may have the same configuration as the image forming apparatus according to the exemplary embodiment of FIGS. 3 through 4B of the present general inventive concept.

Also, as illustrated in FIG. 7, the developing roller 335 is used as a developing member. Alternatively, a developing belt may be employed therefor as necessary. Also, the image forming apparatus according to the embodiment of FIG. 7 of the present general inventive concept may further include a waste toner container 340 to face the pressing member 350, and to be detachably coupled to one side of the developing cartridge 330. The waste toner container 340 is a container to collect a waste toner remaining after the developing process finishes. The waste toner container 340 may be separable from the main frame 300 without separating the developing cartridge 330 from the main frame 300, or may be separable according to mounting and detachment of the developing cartridge 330 or a photosensitive medium cartridge 460 illustrated in FIG. 8.

Also, the image forming apparatus according to the exemplary embodiment of FIG. 7 may further include a first cover 310 and a second cover 320 disposed to a predetermined position of the main frame 300 to be opened and closed. The first cover 310 is formed to open and close in a direction of arrow C, in which the developing cartridge 330 is mounted. When the first cover 310 is opened, the developing cartridge 330 may be mounted in and/or detached from the main frame 300. The second cover 320 is formed on the main frame 300 to open and close in a direction of arrow B to be positioned to one side of the developing cartridge 330 mounted inside the main frame 300. Accordingly, if the second cover 320 is opened, the waste toner container 340 detachably mounted to a side of the developing cartridge 330 can be mounted in and/or detached from the main frame 300. Accordingly, the first and second covers 310 and 320 may be respectively coupled to the main frame 300 by a hinge to rotate about the hinge.

The pressing member 350 is formed on the second cover 320 to elastically press the developing cartridge 330 in the lengthwise direction of the developing roller 335. The pressing member 350 includes an installing part 351 coupled to the second cover 320, and first and second contact parts 353 and 355. The installing part 351 is a part to couple the pressing member 350 to an inner side of the second cover 320, and may be coupled to the inner side of the second cover 320 by a screw as illustrated in FIG. 7, or by an adhesive, a hook member, an insert molding process, or other known coupling components in the art.

The first and second contact parts 353 and 355 protrude toward the developing cartridge 330, and respectively contact with different parts of the developing cartridge 40 or the waste toner container 340. Accordingly, the developing cartridge 330 mounted in the main frame 300 can be prevented from being inclined inside the main frame 300. Here, the pressing member 340 may have the same configuration as the pressing member 50 illustrated in FIG. 3 of the image forming apparatus according to the exemplary embodiment of FIGS. 3 through 4B of the present general inventive concept.

With this configuration, if the developing cartridge 330 is mounted in the direction of the arrow C through an area opened by the first cover 310, the waste toner container 340 is mounted in the direction of the arrow B through a side of the developing cartridge 330 opened by the second cover 320, and the first and second covers 310 and 320 are closed, the pressing member 350 formed to the second cover 320 presses the waste toner container 340, and the waste toner container 340 is pressed so that the developing cartridge 300 coupled with the waste toner container 340 can be pressed. Accordingly, although there is a forming tolerance when the main frame 300 and the developing cartridge 330 are manufactured by the injection molding, the electrodes 35 and 45 illustrated in FIG. 4B, which are positioned to an opposite position to the pressing member 350 can be stably electrically connected with each other.

The pressing member 350 may include a regulating plate having a configuration as illustrated in FIGS. 5 to 6B to be rotatably disposed on the second cover 320, and an elastic member interposed between the regulating plate and the second cover 320 to elastically bias the regulating plate toward the developing cartridge 330. The regulating plate may include a first regulating part and a second regulating part to contact different positions of the developing cartridge 330. The pressing member 350 may have the same configuration as the pressing member 50 of the image forming apparatus according to the exemplary embodiment of FIGS. 5 through 6B of the present general inventive concept.

In the exemplary embodiment of FIG. 7, the first and second covers 310 and 320 are formed on the main frame 300, and the waste toner container 340 is detachably mounted in the main frame 300 through the second cover 320. However, various changes may be employed to the exemplary embodiment of FIG. 7 without departing from the principles and spirit of the present general inventive concept. For example, the pressing member 350 provided to an inner surface of the second cover 320 may directly press a side of the developing cartridge 330 without the waste toner container 340 being detachable.

Also, the pressing member 350 may have a configuration to press and release to interlock with or detach from the second cover 320. That is, a link unit (not illustrated) may be separately provided. If the second cover 320 is closed, the pressing member 350 moves to a pressing position, and if the second cover 320 is opened, the pressing member 350 moves to a releasing position.

Figure 8:
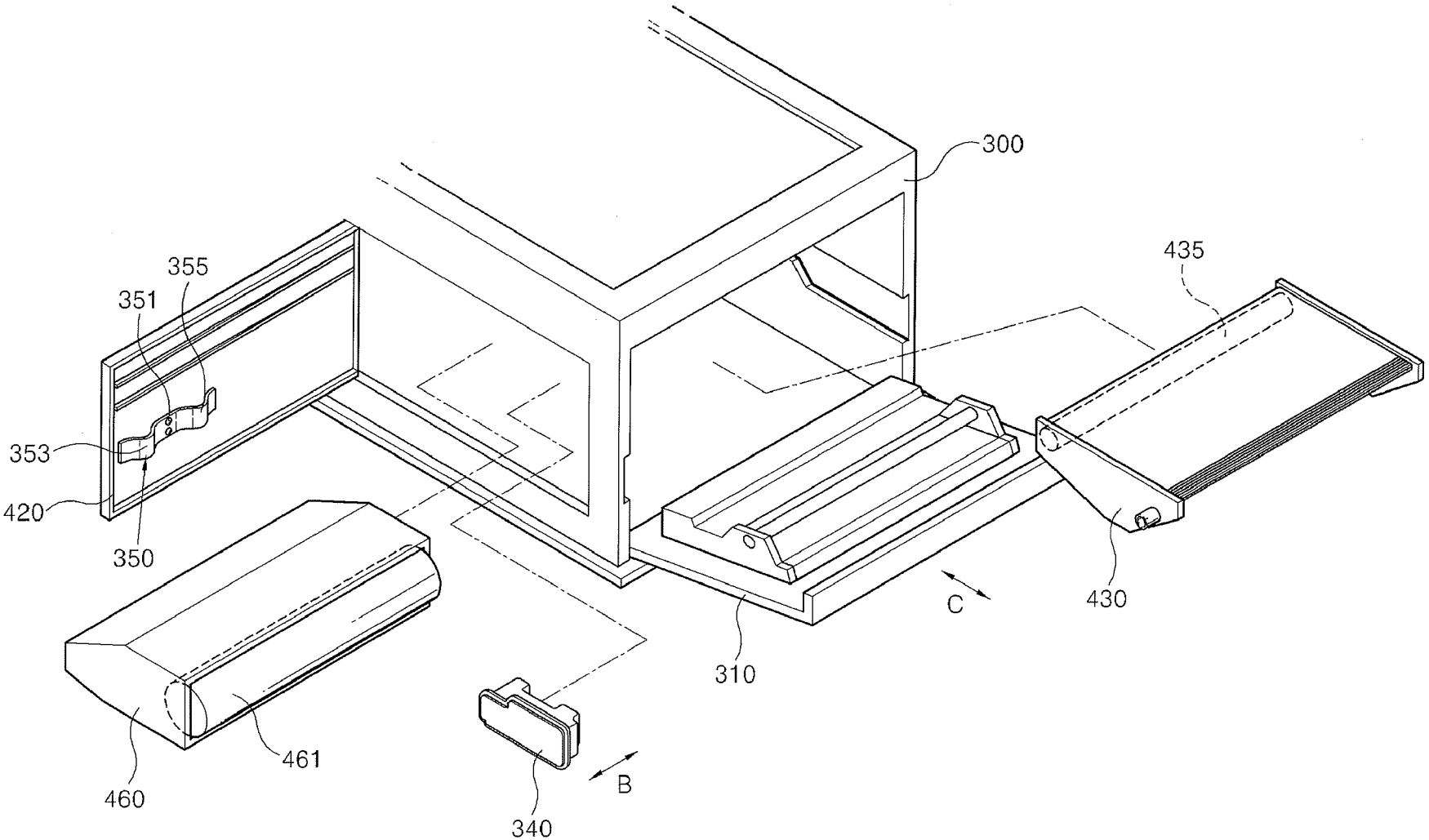
FIG. 8 is an exploded perspective view illustrating a main part of an image forming apparatus according to another exemplary embodiment of the present general inventive concept.

Referring to FIG. 8, an image forming apparatus according to another exemplary embodiment of the present general inventive concept includes a main frame 300, a developing cartridge 430, a photosensitive medium cartridge 460, and a pressing member 350 to press the developing cartridge 430 mounted in the main frame 300 in a lengthwise direction of a developing roller 435 to regulate a widthwise direction movement of the developing cartridge 430.

In comparison with the image forming apparatus according to the exemplary embodiment of FIG. 7 of the present general inventive concept, the image forming apparatus according to the exemplary embodiment of FIG. 8 distinctively includes the separate photosensitive medium cartridge 460 excluding a photosensitive medium from the developing cartridge 430.

The photosensitive medium cartridge 460 includes a photosensitive medium 461 to sense a scanned light beam to form an image, and a cleaning blade (not illustrated) to remove a toner remaining on the photosensitive medium 461. Accordingly, a mounting direction of the photosensitive medium cartridge 460 may be determined independent of a mounting direction of the developing cartridge 430. That is, the photosensitive medium cartridge 460 may be mounted in a direction of arrow B perpendicular to the mounting direction of the developing cartridge 430, or in a direction of arrow C, which is the same direction as the mounting direction of the developing cartridge 430. Also, the photosensitive medium cartridge 460 may be detachably mounted with respect to the main frame 300, or may be securely coupled inside the main frame 300.

Since the photosensitive medium cartridge 460 has a longer life span than the developing cartridge 430, a replacement period of the developing cartridge 430 is relatively short. Accordingly, if the developing cartridge 430 and the photosensitive medium cartridge 460 are separately provided, as in the exemplary embodiment of FIG. 8, the replacement period can be independently determined, thereby reducing an unnecessary expendable replacement of the photosensitive medium cartridge 460.

As illustrated in FIG. 8, if the photosensitive medium cartridge 460 is configured to be mounted in the direction of the arrow B, a second cover 420 has a bigger width than the second cover 230 according to the exemplary embodiment of FIG. 7 of the present general inventive concept.

Since regulation of the widthwise direction movement of the developing cartridge 430 is required relatively more frequently than regulation of the movement of the photosensitive medium cartridge 460 due to a replacement period difference, the position of a regulating member 320 is determined with a consideration of a mounting position of the developing cartridge 430. In addition to regulating the developing cartridge 430, the regulating member 320 contacts to the photosensitive medium cartridge 460 at a predetermined position to regulate the widthwise direction movement of the photosensitive medium cartridge 460, thereby preventing the photosensitive medium cartridge 460 from being inclined inside the main frame 300.

As described above, an image forming apparatus according various embodiments to the present general inventive concept can prevent a driving force transmission inferiority and a power supplying inferiority due to a forming tolerance generated when a main frame and a developing cartridge are manufactured by an injection molding process.

That is, by designing an inner width of the main frame wider than a width of the developing cartridge with a prediction of deformations from injection conditions of the main frame and the developing cartridge, and from a usage environment, a jitter problem corresponding to an image and a noise problem generated in the conventional developing cartridge forcedly mounted due to insufficient marginal space between the main frame and the developing cartridge can be fundamentally solved.

Also, since the pressing member prevents an electrical connection inferiority between the developing cartridge and the main frame, the power supplying inferiority can be prevented. Also, by determining the widths of first and second driving force transmitting parts with consideration of a forming margin, a driving force transmission can be smoothly accomplished.

Also, although a separate cover is provided to open and close in a side, the present general inventive concept may be applied thereto, thereby efficiently pressing the developing cartridge.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a main frame, comprising:

a first driving force transmitting part, and a first electrode to supply power;

a developing cartridge mounted in the main frame, comprising:

a second driving force transmitting part engaged to the first driving force transmitting part to receive a driving force and a second electrode electrically connected with the first electrode; and a pressing member separate from the main frame and mounted to one side of the main frame to contact plural parts of the developing cartridge and to regulate a widthwise direction movement of the developing cartridge mounted in the main frame to guide an engagement between the first and second driving force transmitting parts and an electrical connection between the first and second electrodes.

2. The image forming apparatus according to claim 1, wherein the pressing member comprises:

an elastic plate disposed on the main frame to elastically press the developing cartridge in a direction in which the first and second electrodes are electrically connected with each other.

3. The image forming apparatus according to claim 2, wherein the elastic plate comprises:

an installing part coupled to the main frame; and a first contact part and a second contact part to protrude toward the developing cartridge to contact with different positions of the developing cartridge.

4. The image forming apparatus according to claim 1, wherein the pressing member comprises:

a regulating plate rotatably disposed to the main frame; and an elastic member interposed between the regulating plate and the main frame to elastically bias the regulating plate so that the developing cartridge can be positioned in a direction in which the first and second electrodes contact each other.

5. The image forming apparatus according to claim 4, wherein the regulating plate comprises:

a first regulating part and a second regulating part to contact different positions of the developing cartridge.

6. The image forming apparatus according to claim 1, wherein the main frame comprises resin or metal.

* * * * *